US006123611A

United States Patent [19]

Lawrence, Jr.

[11] Patent Number: 6,123,611

[45] Date of Patent: Sep. 26, 2000

[54] BLADE SHARPENING APPARATUS

[76] Inventor: Orin J. Lawrence, Jr., 2660 Hickory Tree Rd., St. Cloud, Fla. 34772

[21] Appl. No.: 09/468,070

[22] Filed: Dec. 20, 1999

[51] Int. Cl.[7] ..... B24B 41/00

[52] U.S. Cl. ..... 451/361; 451/340; 451/312; 451/455

[58] Field of Search ..... 451/45, 57, 28, 451/65, 177, 178, 193, 312, 340, 321, 360, 361, 405, 451, 452, 453, 455

[56] References Cited

U.S. PATENT DOCUMENTS

| | | | |
|---|---|---|---|
| 455,418 | 7/1891 | Sweeney et al. | 451/405 |
| 1,434,131 | 10/1922 | Lutz | 451/361 |
| 2,782,570 | 2/1957 | Ische . | |
| 3,755,971 | 9/1973 | Garcia . | |
| 4,265,146 | 5/1981 | Horrell . | |
| 4,736,544 | 4/1988 | Greequist . | |
| 4,841,678 | 6/1989 | Thomas . | |
| 4,936,053 | 6/1990 | Shanelec . | |
| 5,062,322 | 11/1991 | Sinko . | |
| 5,525,095 | 6/1996 | Baugman | 451/361 |
| 5,676,592 | 10/1997 | Borgatti | 451/361 |

*Primary Examiner*—Derris H. Banks
*Attorney, Agent, or Firm*—William M. Hobby, III

[57] ABSTRACT

A lawn mower blade sharpening apparatus has a standard bench grinder having a grinding wheel thereon attached to a workbench. A lawn mower blade support frame is attached to the workbench adjacent the bench grinder and has a blade support surface hinged to the frame and a cutout area therein having the bench grinder grinding wheel extending through the cutout so that the blade support surface can be rotated on the hinge adjacent the grinding wheel to vary the angle of the blade support surface to the grinding wheel. A threaded adjustment bolt is threaded through the frame and abuts the blade support surface and has a gripping handle on one end thereof and an abutment cap on the other end thereof. Threading the threaded adjustment bolt in and out adjusts the angle of the hinge blade support surface to change the angle of the support relative to the grinding wheel for sharpening blades at different angles on the grinding wheel while supported on the blade support surface. Spark shielding walls are attached to the frame base and blade support surface to cooperate with each other to shield a user from grinding sparks.

9 Claims, 3 Drawing Sheets

BLADE SHARPENING APPARATUS

BACKGROUND OF THE INVENTION

The present invention relates to a lawn mower blade sharpening apparatus and especially to a blade sharpening apparatus for use with a standard bench grinder mounted on a workbench.

Lawn mower blades for rotary lawn mowers require frequent sharpening as a result of the blade becoming dull from the operation of the lawn mower cutting grass, weeds and the like and from the blade surface becoming roughened by impact with sand, gravel and small objects in the path of the lawn mower blade. Rotary lawn mower blades typically are one elongated flat member having opposite surfaces thereon sharpened at a predetermined angle. The blades are attached to a rotating shaft enclosed in a housing and rotate the sharpened edges to cut grass.

There have been a variety of lawn mower blade sharpening devices provided in the past, some of which sharpen the blade while still attached to the lawn mower while others remove the blade for sharpening. One prior art U.S. Pat. No. 5,062,322 to Sinko is a self-contained electric motor driven lawn mower blade sharpening machine for use in sharpening rotary lawn mower blades. The machine has a base for mounting the motor drive with an abrasive wheel and a free floating blade guide which allows sharpening of unevenly worn blades to a beveled angle of 30 degrees along the contoured cutting edge. In the Shanelec U.S. Pat. No. 4,936,053 a lawn mower blade sharpener apparatus is attachable to an existing bench grinder assembly having a rotating grinding wheel to sharpen an edge portion on a lawn mower blade and includes a stationary grinder attachment assembly which is clamped to an object support assembly on the bench grinder assembly. A pair of movable blade attachment assemblies holding and move a blade across the grinder. The Horrell U.S. Pat. No. 4,265,146 is a device for sharpening a lawn mower blade having an abrasive wheel attached thereto. A base holds the drill in a substantially horizontal position and a clamp holds the lawn mower blade and has a rail adjustably attached to the base. A rail follower is slidably attached to the rail for reciprocating movement thereon substantially parallel to the longitudinal axis of the abrasive wheel to sharpen a blade clamped to the rail follower. The Thomas U.S. Pat. No. 4,841,678 is a tool sharpening apparatus for use in combination with a grinding wheel aligned for multiple adjustment and angular displaceable supports for sharpening tools.

The present invention is directed for sharpening a lawn mower blade at different angles and which utilizes an existing bench grinder attached to a work bench. A frame with a blade supporting surface is attached to the workbench over the bench grinder grinding wheel. The use of an existing bench grinder with a simplified blade support reduces the cost and simplifies the operation of the lawn mower blade sharpener of the present invention.

SUMMARY OF THE INVENTION

A lawn mower blade sharpening apparatus has a standard bench grinder having a grinding wheel thereon attached to a workbench. A lawn mower blade support frame is attached to the workbench adjacent the bench grinder and has a blade support surface hinged to the frame and a cutout area therein having the bench grinder grinding wheel extending through the cutout so that the blade support surface can be rotated on the hinge adjacent the grinding wheel to vary the angle of the blade support surface to the grinding wheel. A threaded adjustment bolt is threaded through the frame and abuts the blade support surface and has a gripping handle on one end thereof and an abutment cap on the other end thereof. Threading the threaded adjustment bolt in and out adjusts the angle of the hinge blade support surface to change the angle of the support relative to the grinding wheel for sharpening blades at different angles on the grinding wheel while supported on the blade support surface. The base of the frame has upright side walls to block flying sparks and the blade support surface has cooperating perpendicular walls acting as a spark shield as the blade support surface is raised and lowered.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
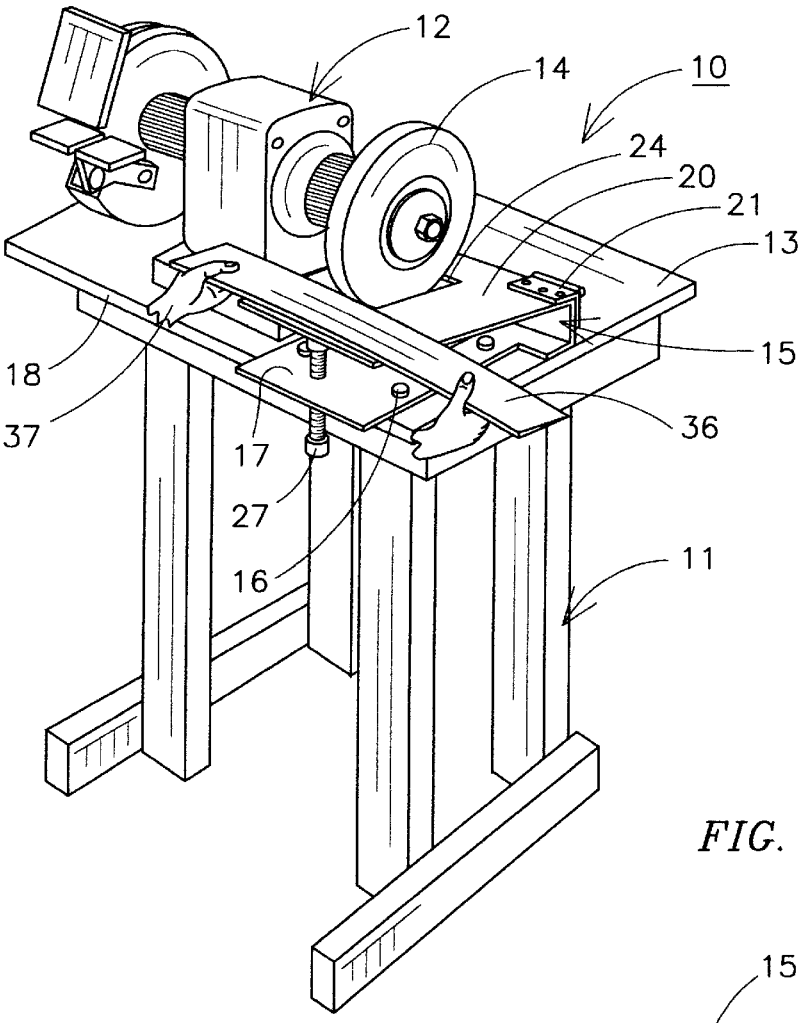
FIG. 1 is a perspective view of a lawn mower blade sharpening apparatus in accordance with the present invention having a blade positioned thereon.
Figure 2:
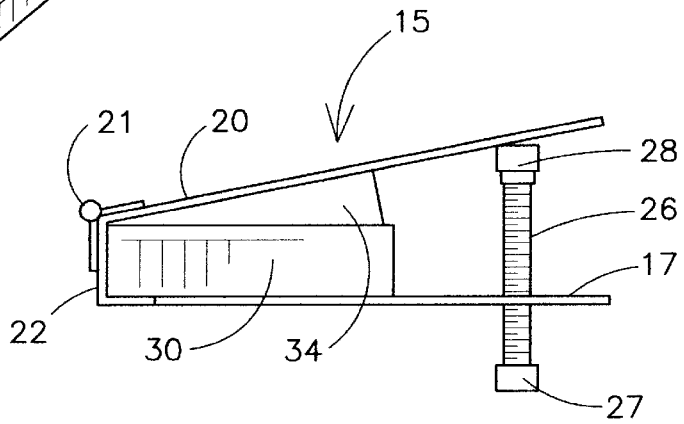
FIG. 2 is a sectional view taken through the blade supporting frame.
Figure 3:
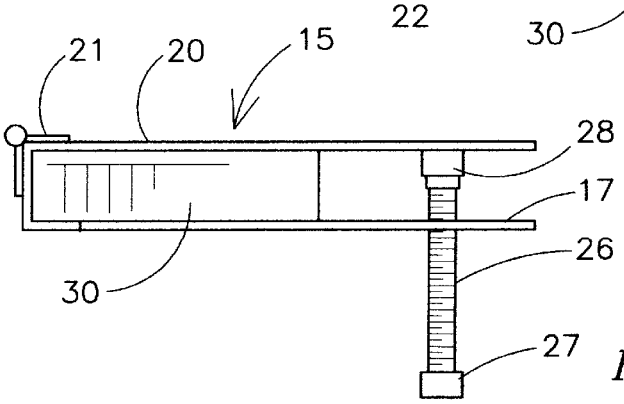
FIG. 3 is a sectional view taken through the blade supporting frame having the blade support surface raised.
Figure 4:
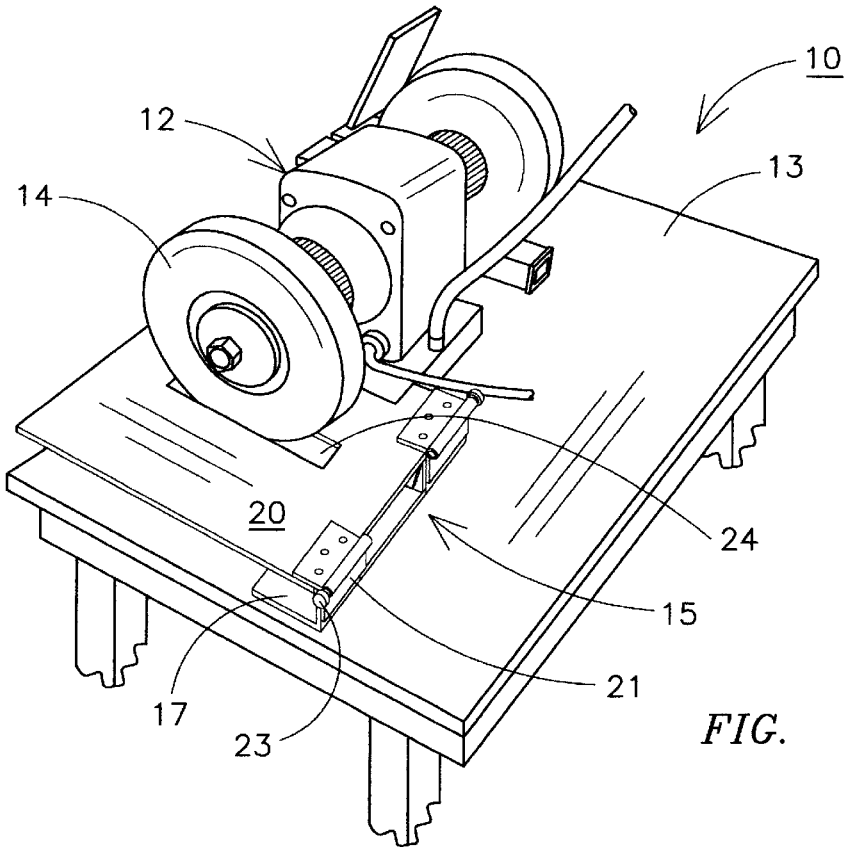
FIG. 4 is a perspective view of a lawn mower blade sharpener of FIG. 1.
Figure 5:
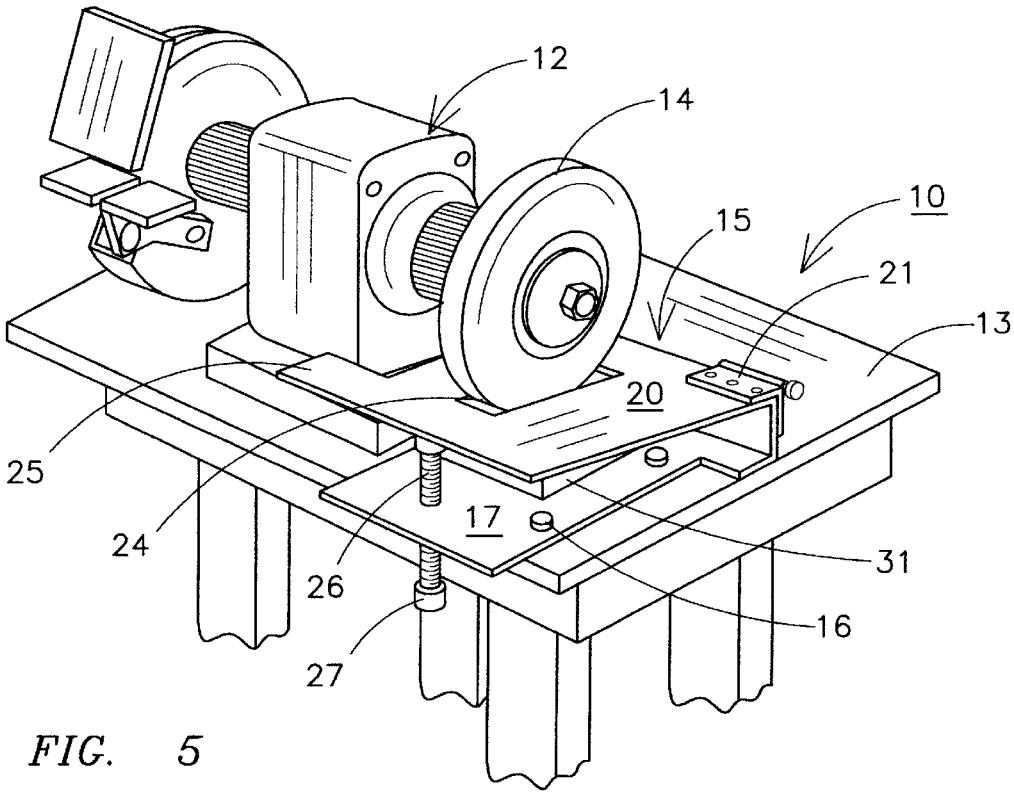
FIG. 5 is front perspective view of the lawn mower blade sharpener of FIGS. 1 and 4.
Figure 6:
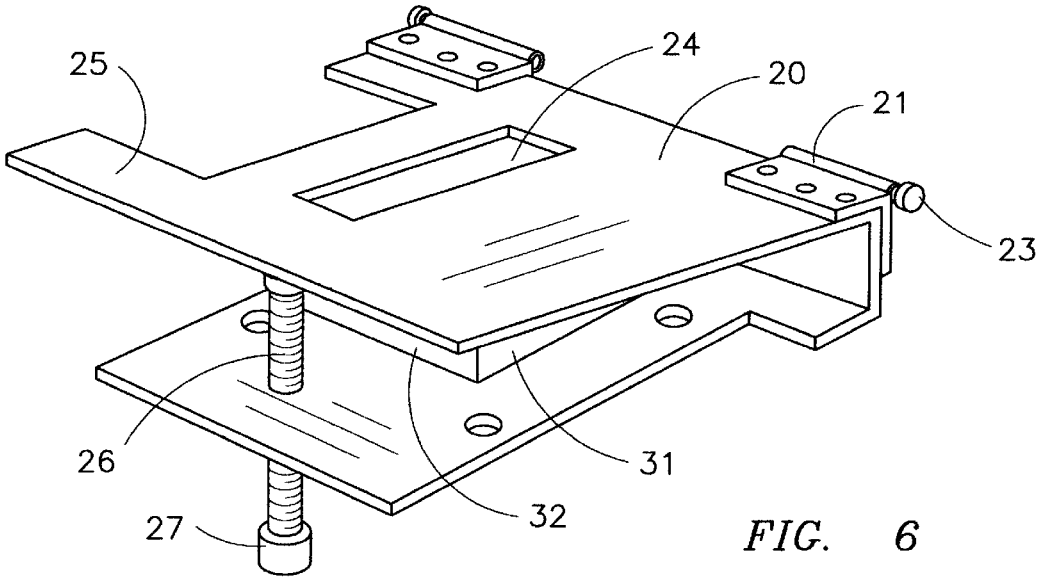
FIG. 6 is a perspective view of the blade support frame of the blade sharpener of FIGS. 1–5.
Figure 7:
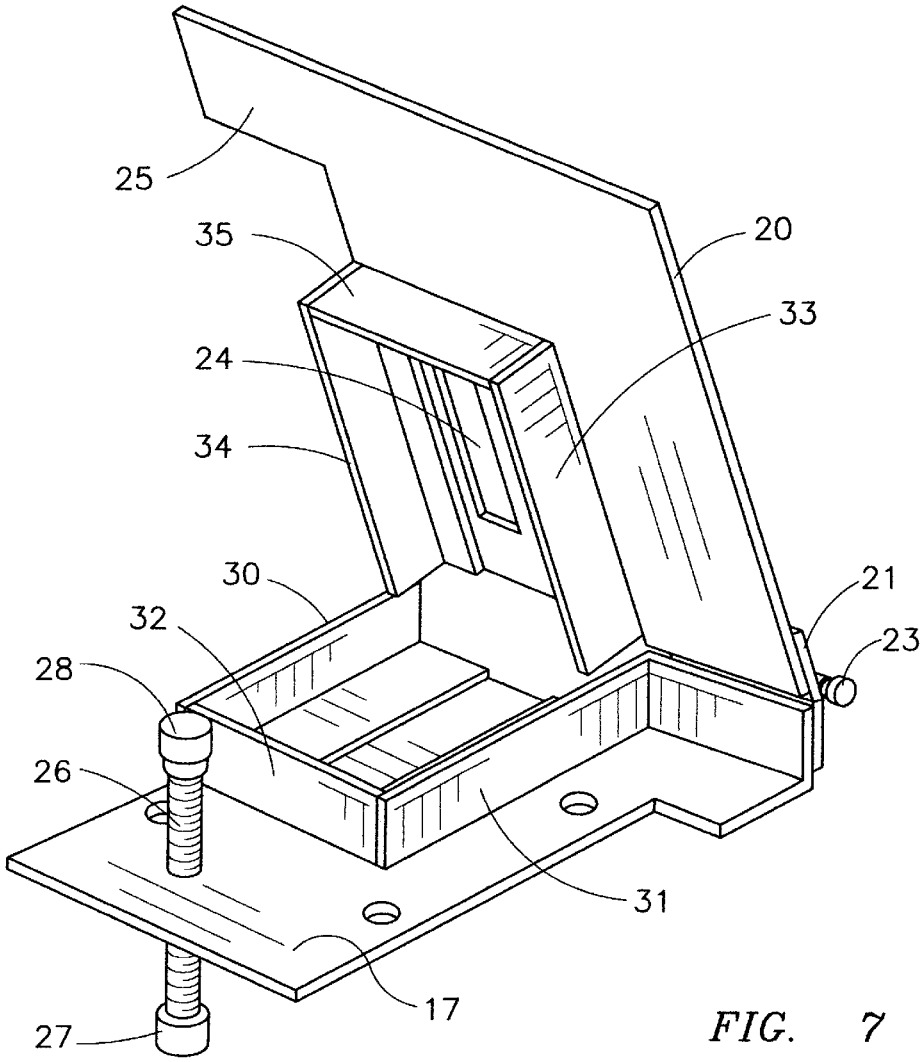
FIG. 7 is a perspective view of the blade support frame of FIG. 6 in an open position.

Referring to the drawings, FIGS. 1 through 7, a blade sharpening apparatus 10 has a workbench 11 having a bench grinder 12 mounted to the top 13 thereof. The bench grinder 12 has a grinding wheel 14 extending from one side thereof. The workbench 11 has the blade holding frame 11 attached to the top 13 with a plurality of bolts 16. The blade sharpening frame 15 has a base 17 having the bolts 16 bolted thereto to the top 13. The base 17 extends forward of the front edge 18 of the workbench 11. Frame 15 has a blade supporting member 20 hinged with a pair of hinges 21 to an upright frame member 22 attached to the base frame member 17. The pair of hinges 21 each have a removable hinge pin 23 so that the blade support plate 20 can be removed. The blade support plate 20 has a generally rectangular opening 24 therein positioned for the grinding wheel 14 to fit into from the top of the frame 15. The blade holding plate 20 also has an extension 25 extending therefrom. The frame 15 also has a threaded adjustment bar 26 having a gripping handle 27 on one end and an abutment cap 28 on the other end thereof. The abutment cap can be flexibly rotatably mounted to the end of the threaded adjustment bar 26 and can be made of a self-lubricating polymer, such as nylon. The frame 15 base plate 17 has a pair of upright side spark guard walls 30 and 31 attached thereto and perpendicular to a third upright spark guard wall 32. In addition, the blade support plate 20 has a pair of side spark guard walls 33 and 34 and a front spark guard wall 35. The spark guard walls 33, 34, and 35 can be seen as falling within the base spark guard walls 30, 31 and 32 so that upon raising the blade support plate 20, the spark guards 33, 34 and 35 are raised to maintain the sparks protection.

In operation, a rotary lawn mower blade 36 can be held in a person's hands 37 on top of the blade support plate 20, as seen in FIG. 1, having additional support by the extension 25. The angle of the plates 20 can be adjusted by rotating the knob 27 to thread the threaded adjustment bar 26 up or down to move the angle of the blade support plate 20 as it is rotated on the hinges 21 for adjusting the angle that the grinder wheel 14 will intersect the blade 36. The abutment knob 28 advantageously allows an easy rotation of the adjustment rod 26 as it moves the plate 20. The blade 36 can then be slid back and forth to sharpen each side of the blade while protecting the user of the grinder from the sparks which are entrapped in the spark containing box formed by the base spark protector walls 30, 31 and 32 and blade support plate spark protector walls 33, 34, and 35. Plate 20 can be rapidly adjusted by the operator using one hand to rotate the handle 27 to move the bar 26 up and down while holding a blade 36 on the support plate 20 until the angle for a particular blade is positioned at the correct angle.

It should be clear at this time that a lawn mower blade sharpening apparatus has been provided which is simple to manufacture for use with existing bench grinders and workbenches and which can be rapidly adjusted for different blades while protecting the user against flying sparks. However, the present invention should not be construed as limited to the forms shown which are to be considered illustrative rather than restrictive.

I claim:

1. A blade sharpening apparatus comprising:

a bench grinder having a grinding wheel thereon and mounted on a workbench;

a blade support frame attached to said workbench adjacent said bench grinder and having a base frame member for attaching to said workbench, said blade support frame base has a plurality of generally upright spark shield surfaces attached thereto adjacent said grinding wheel, wherein said shield surfaces are below said blade support surface;

a blade support surface hinged to said frame and having a cutout area therein having said bench grinder grinding wheel extending therethrough, said hinged blade support surface being rotatable on said hinge to position said support surface at varying angles to said grinding wheel; and a threaded adjustment member threaded through said frame base member and abutting said blade support surface, whereby varying the position of said threaded adjustment member adjusts an angle of said hinged blade support surface to change the angle of said support surface relative to said grinding wheel for sharpening blades on said grinding wheel supported on said blade support surface.

2. A blade sharpening apparatus in accordance with claim 1 in which said blade support surface has a plurality of generally perpendicular spark shield surfaces attached thereto adjacent said grinding wheel and facing said plurality of generally upright spark shield surfaces attached to said blade support frame base.

3. A blade sharpening apparatus in accordance with claim 2 in which said threaded adjustment member has two ends and has a gripping handle on one end thereof.

4. A blade sharpening apparatus in accordance with claim 3 in which said threaded adjustment member has an abutment cap on the other end thereof abutting said blade support surface.

5. A blade sharpening apparatus in accordance with claim 4 in which said abutment cap is a self lubricating polymer.

6. A blade sharpening apparatus in accordance with claim 5 in which said abutment cap is rotatably mounted to said threaded adjustment member other end.

7. A blade sharpening apparatus in accordance with claim 6 in which said blade support frame base member is bolted to said workbench.

8. A blade sharpening apparatus in accordance with claim 7 in which said blade support surface is mounted to said blade support frame with a pair of hinges.

9. A blade sharpening apparatus in accordance with claim 8 in which said blade support frame and blade support surface are made of steel.

* * * * *